US007475481B1

(12) United States Patent
Napoli

(10) Patent No.: US 7,475,481 B1
(45) Date of Patent: Jan. 13, 2009

(54) BODY HAIR SHAVING DEVICE

(76) Inventor: Joseph A. Napoli, 5317 Denny Ave., Apartment #109, North Hollywood, CA (US) 91601

( * ) Notice: Subject to any disclaimer, the term of this patent is extended or adjusted under 35 U.S.C. 154(b) by 131 days.

(21) Appl. No.: 11/468,999

(22) Filed: Aug. 31, 2006

(51) Int. Cl.
*B26B 21/00* (2006.01)
*B26B 21/40* (2006.01)

(52) U.S. Cl. ..... 30/43.4; 30/45; 30/47; 30/50; 30/541

(58) Field of Classification Search ..... 30/43.4, 30/526, 537, 49, 529, 85, 87, 90, 346.55, 30/346.57, 541, 40, 34.05, 34.1, 34.2, 45, 30/43.91, 43.92, 44, 47, 50; 16/115; 15/144.3, 15/144.4; D28/49–53
See application file for complete search history.

(56) References Cited

U.S. PATENT DOCUMENTS

| | | | | | |
|---|---|---|---|---|---|
| 2,810,953 | A | | 10/1957 | Brody | |
| 3,141,240 | A | * | 7/1964 | Gwinn | 30/43 |
| 4,461,078 | A | * | 7/1984 | Carreker | 30/47 |
| 4,791,724 | A | * | 12/1988 | Dumas | 30/526 |
| 4,893,641 | A | | 1/1990 | Strickland | |
| D314,642 | S | * | 2/1991 | Ying | D28/50 |
| 5,208,982 | A | | 5/1993 | Ferruzza, Jr. | |
| 5,341,570 | A | * | 8/1994 | Kumakawa | 30/43.6 |
| 5,704,127 | A | | 1/1998 | Cordio | |
| 6,029,356 | A | * | 2/2000 | Sprinkle | 30/298 |
| 6,112,421 | A | * | 9/2000 | Greene | 30/526 |
| D472,673 | S | | 4/2003 | Carvotta et al. | |
| 7,040,024 | B2 | * | 5/2006 | Lukan et al. | 30/541 |
| 2004/0107585 | A1 | | 6/2004 | Helmrich | |
| 2004/0194325 | A1 | | 10/2004 | Ehrlich et al. | |

* cited by examiner

*Primary Examiner*—Ghassem Alie

(57) ABSTRACT

A body hair shaving device for shaving hair from a body of a person and preventing being accidentally cut by a razor blade includes a housing being graspable by a hand of a person. The housing has a top wall, a bottom wall and a peripheral wall attached to and extending between the top and bottom walls. The housing is divided into a first section and a second section. The first section is hingedly coupled to the second section. The housing is positionable in a closed position having the bottom wall of the first and second sections being adjacent to each other or an open position having the top wall of the first and second sections lying in a same plane. A razor assembly is coupled to the housing and split between the first and second sections to shave hair from a body when the razor assembly is turned on.

9 Claims, 5 Drawing Sheets

BODY HAIR SHAVING DEVICE

BACKGROUND OF THE INVENTION

1. Field of the Invention

The present invention relates to curved surface shavers and more particularly pertains to a new curved surface shaver for shaving hair from a body of a person and preventing being accidentally cut by a razor blade.

2. Description of the Prior Art

The use of curved surface shavers is known in the prior art. The prior art commonly teaches the use of razor blades with curved faces to shave convex and concave surfaces of the body. While these devices fulfill their respective, particular objectives and requirements, the need remains for a device that has certain improved features that allows separate sections of a housing of the device to pivot with respect to each other and allow the housing to better conform to the contours of the body. Additionally, the device includes a plurality of shaving heads that shave the hair from the body and are designed to not cut the body when the shaving heads are in contact with the body.

SUMMARY OF THE INVENTION

The present invention meets the needs presented above by generally comprising a housing being graspable by a hand of a person. The housing has a top wall, a bottom wall and a peripheral wall attached to and extending between the top and bottom walls. The housing is divided into a first section and a second section. The first section is hingedly coupled to the second section. The housing is positionable in a closed position having the bottom wall of the first and second sections being adjacent to each other or in an open position having the top wall of the first and second sections lying in a same plane. A razor assembly is coupled to the housing. The razor assembly includes a plurality of shaving heads coupled to and outwardly extending from the bottom wall of the housing. The shaving heads are drawn across the body of the person to shave hair from a body when the razor assembly is turned on. At least one of the shaving heads is positioned on the first section and at least one of the shaving heads is positioned on the second section.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
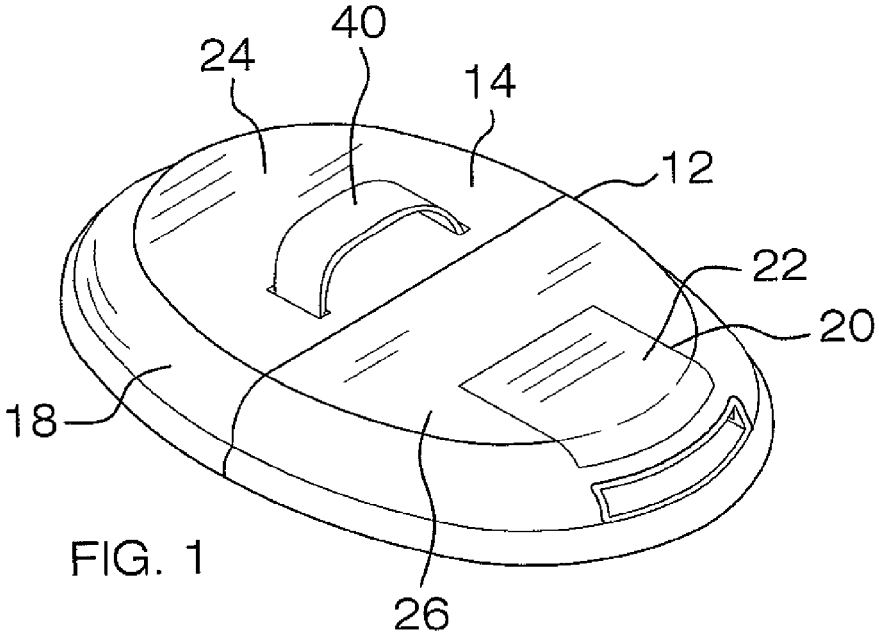
FIG. 1 is a top perspective view of a body hair shaving device according to the present invention.
Figure 2:
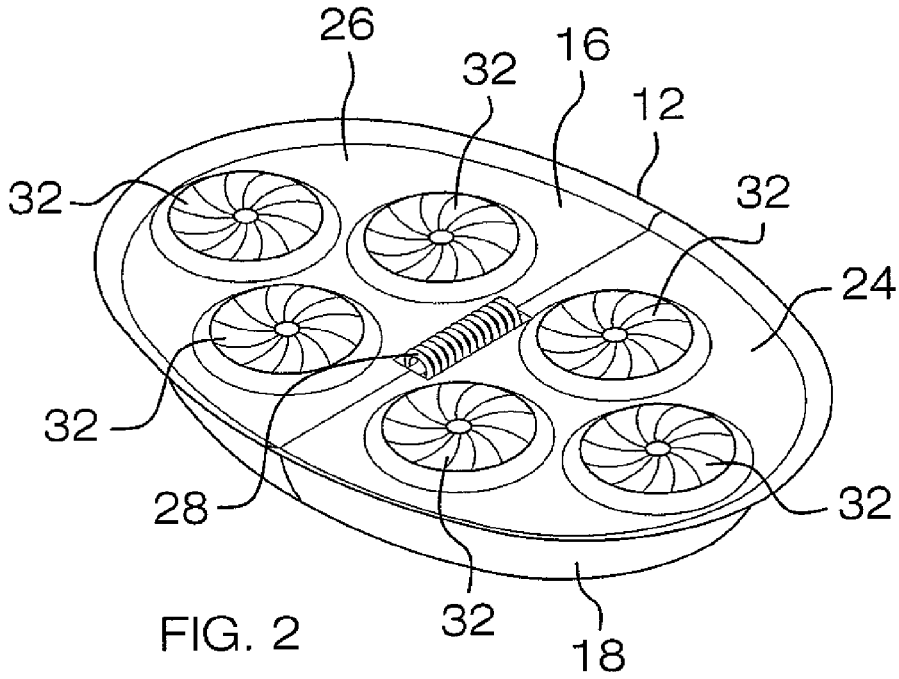
FIG. 2 is a bottom perspective view of the present invention.
Figure 3:
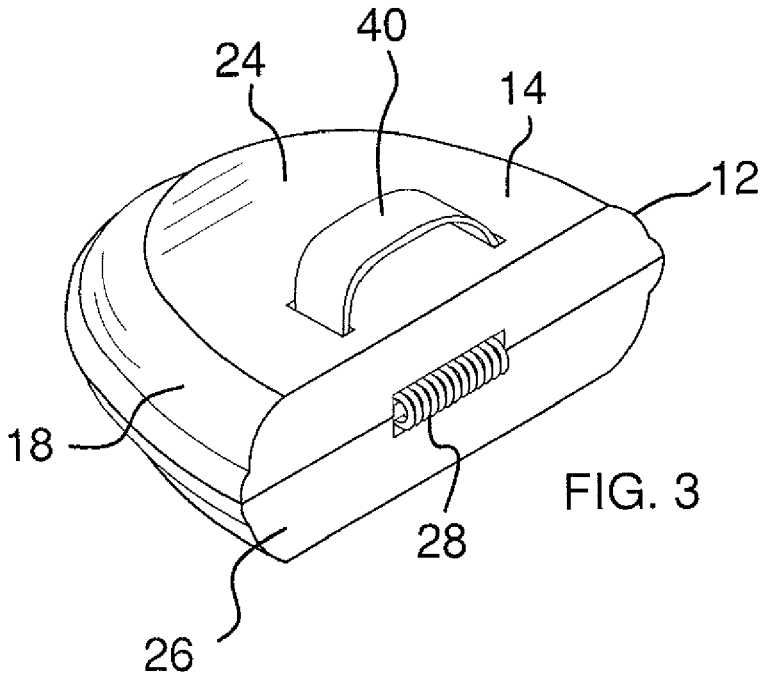
FIG. 3 is a top perspective view of the housing of the present invention in the closed position.
Figure 4:
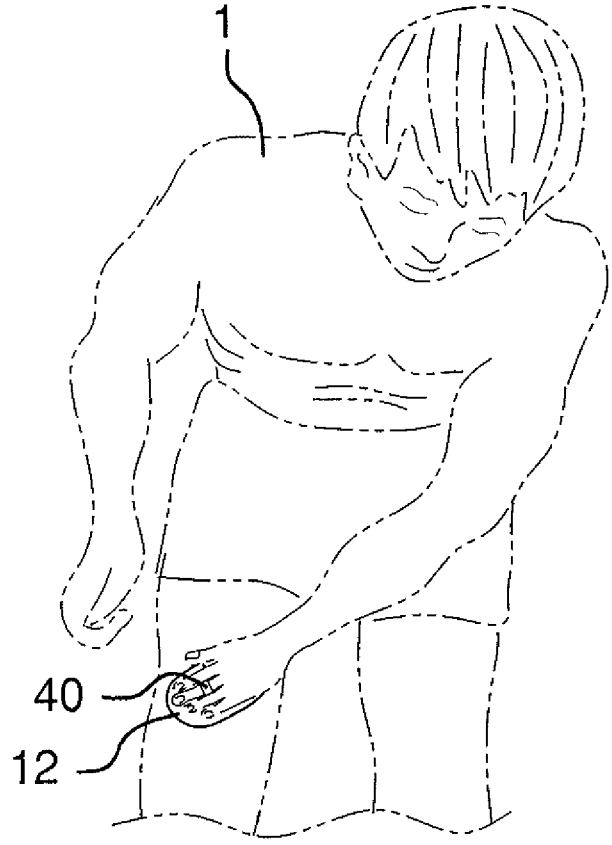
FIG. 4 is a perspective view of the present invention shown in use.
Figure 5:
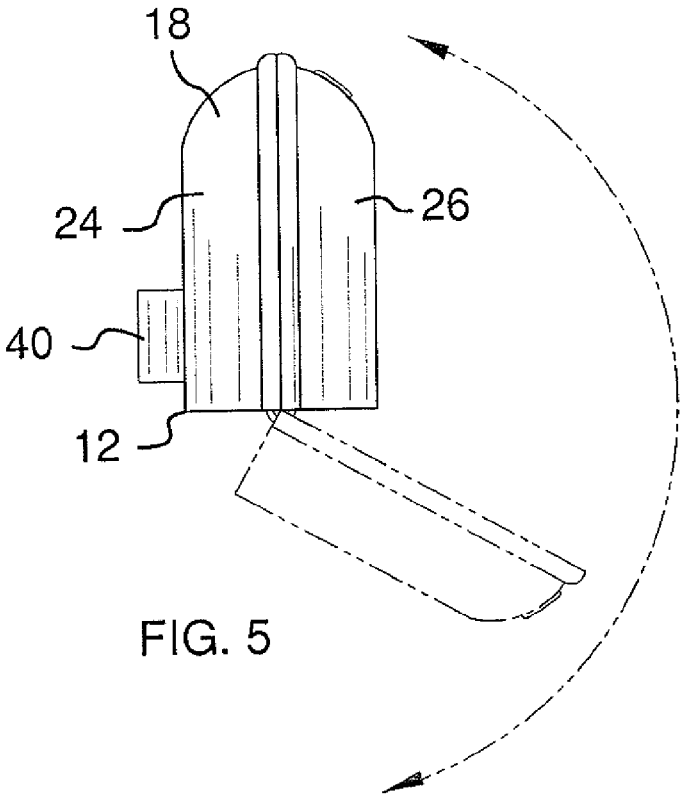
FIG. 5 is a side view of the present invention.
Figure 6:
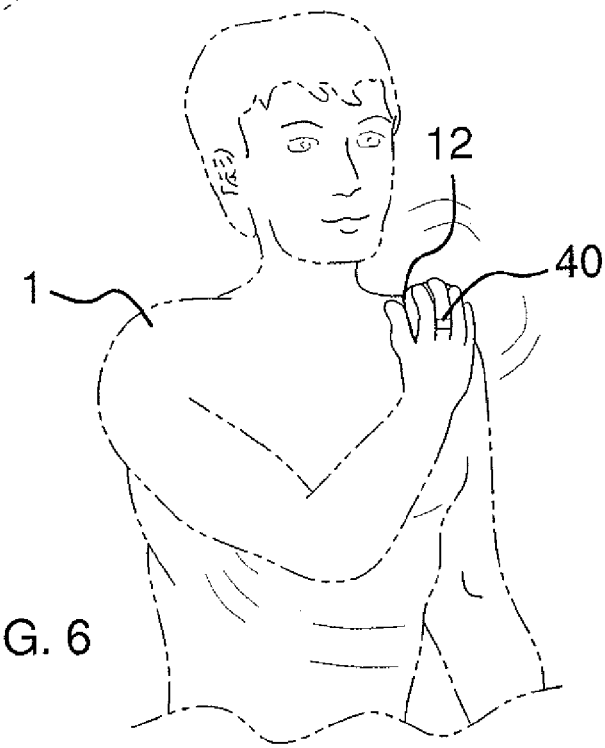
FIG. 6 is a perspective view of the present invention in use.
Figure 7:
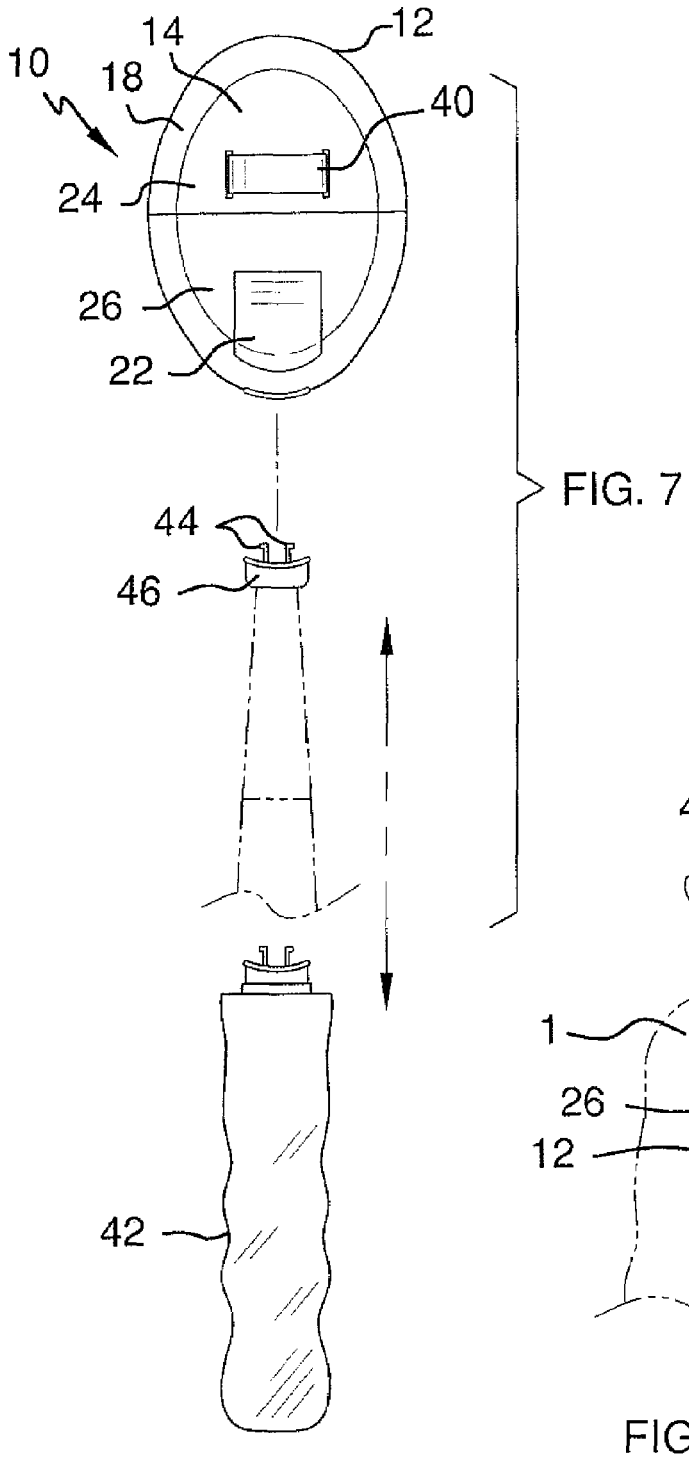
FIG. 7 is a top view of the present invention with the handle.
Figure 8:
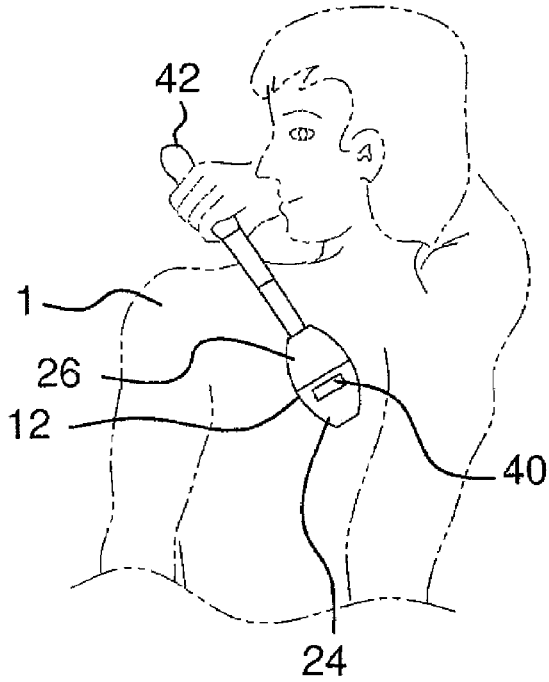
FIG. 8 is a top view of the present invention shown in FIG. 7 in use.
Figure 9:
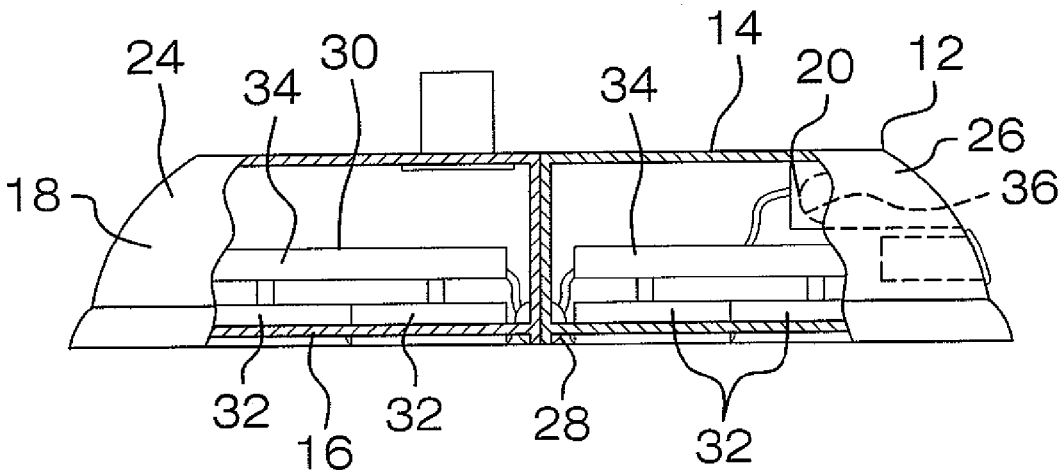
FIG. 9 is a partial cross-sectional view of the present invention.
Figure 10:
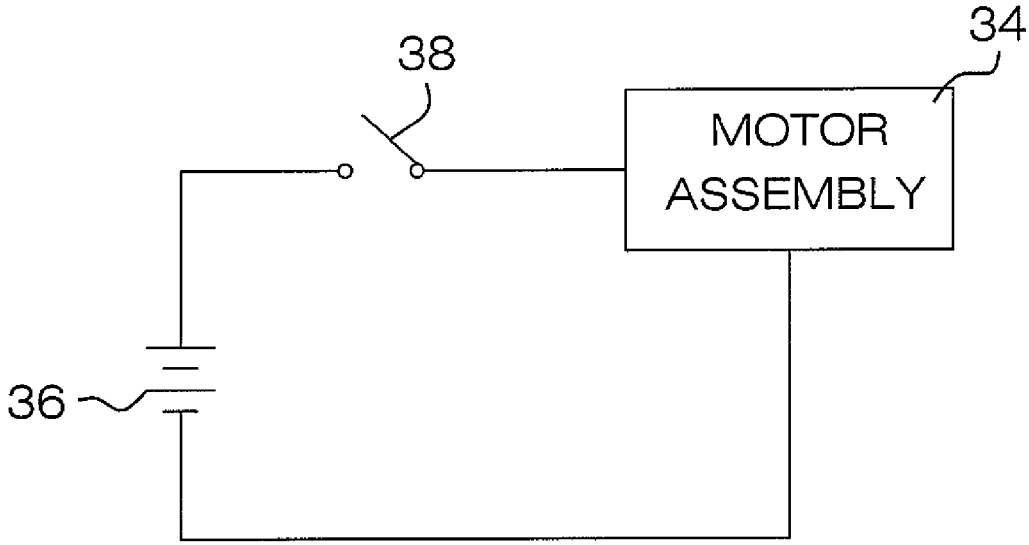
FIG. 10 is a schematic view of the present invention.

With reference now to the drawings, and in particular to FIGS. 1 through 10 thereof, a new curved surface shaver embodying the principles and concepts of the present invention and generally designated by the reference numeral 10 will be described.

As best illustrated in FIGS. 1 through 10, the body 1 hair shaving device 10 generally comprises a housing 12 being graspable by a hand of a person. The housing 12 has a top wall 14, a bottom wall 16 and a peripheral wall 18 being attached to and extending between the top 14 and bottom 16 walls. The housing 12 has a bay 20 extending therein. A door 22 is coupled to the housing 12 and is selectively positionable in a closed position extending over the bay 20. The housing 12 is divided into a first section 24 and a second section 26 each approximately having a same size and shape. The first section 24 is hingedly coupled to the second section 26. The housing 12 is positionable in a closed position having the bottom wall 16 of the first and second sections 24,26 being adjacent to each other or an open position having the top wall 14 of the first and second sections 24,26 lying in a same plane. A biasing member 28 is coupled to the first section 24 and the second section 26 of the housing 12. The biasing member 28 biases the first and second sections 24,26 into the open position.

A razor assembly 30 is coupled to the housing 12. The razor assembly 30 includes a plurality of shaving heads 32 being coupled to and outwardly extending from the bottom wall 16 of the housing 12 and a at least one motor assembly 34 engaging and selectively actuating each of the shaving heads 32. The at least one motor assembly 34 may be configured to provide either rotary or oscillatory movement to accommodate either rotary or oscillating shaving heads 32. The shaving heads 32 are drawn across a body 1 of the person to shave hair from the body 1 when the razor assembly 30 is turned on. At least one of the shaving heads 32 is positioned on the first section 24 and at least one of the shaving heads 32 is positioned on the second section 26.

A power supply 36 is positionable in the bay 20 of the housing 12. The power supply 36 supplies power to the razor assembly 30. A switch 38 is in electrical communication with the power supply 36 and the at least one motor assembly 34 to control the flow of power from the power supply 36 to the razor assembly 30. The switch 38 may comprise a magnetic type of switch 38 to discontinue flow of power to the razor assembly 30 when the housing 12 is in the closed position. Additionally, the switch 38 may include one of a variety of manual switches 38 that require manual manipulation of the switch 38 itself or through the movement of the housing 12 between the open and closed positions to control the flow of the power to the razor assembly 30.

A strap 40 is coupled to the top wall 14 of the housing 12. The strap 40 is extendable over a finger of the hand to secure the housing 12 to the hand and facilitates maneuvering of the housing 12 by the person. The strap 40 may be comprised of an elastic material to allow the strap 40 to retract against the top wall 14 of the housing 12 when the finger is not positioned between the housing 12 and the strap 40. A handle 42 is releasably coupled to the housing 12. The handle 42 is graspable by the person to extend a reach of the person when shaving the body 1. The handle 42 is telescopic to permit a length of the handle 42 to be adjusted. The handle 42 includes a plurality of clips 44. Each of the clips 44 is coupled to an engaging end 46 of the handle 42. Each of the clips 44 engages the housing 12 to selectively couple the handle 42 to the housing 12.

In use, the housing 12 is pivoted to the open position and the razor assembly 30 is turned on. The bottom wall 16 with the shaving head 32 is drawn across the body 1 to allow the shaving heads 32 to shave the hair from the body 1. The first and second sections 24,26 may be pivoted slightly toward the closed position to allow the housing 12 to extend over curved portions of the body 1 and allow the housing 12 and the shaving heads 32 to more closely follow the contours of the body 1.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A body hair shaving device for shaving hair from a body of a person, said device comprising:

a housing being graspable by a hand of the person, said housing having a top wall, a bottom wall and a peripheral will being attached to and extending between said top and bottom walls, said housing being divided into a first section and a second section, said first section being hingedly coupled to said second section, said housing being positionable in a closed position having said bottom wall of said first and second sections being adjacent to each other and an open position having said top wall of said first and second sections lying in a same plane; a razor assembly being coupled to said housing, said razor assembly including a plurality of shaving heads being coupled to and outwardly extending from said bottom wall of aid housing, said shaving heads being drawn across the body of the person to shave the hair from the body when the razor assembly is turned on, at least one of said shaving heads being positioned on said second section; and an elongated handle being releasably coupled to said housing, said handle being graspable by the person to extend a reach of the person when shaving the body.

2. The device according to claim 1, wherein said first section and said second section have approximately a same size and shape.

3. The device according to claim 1, wherein said housing has a bay extending therein, a door being coupled to said housing and being selectively positionable in a closed position extending over said bay.

4. The device according to claim 3, further comprising a power supply being positionable in said bay of said housing, said power supply supplying power to said razor assembly.

5. The device according to claim 1, wherein said razor assembly includes a at least one motor assembly engaging and selectively actuating each of said shaving heads.

6. The device according to claim 1, further comprising a biasing member being coupled to said first section and said second section of said housing, said biasing member biasing said first and second sections into said open position.

7. The device according to claim 1, further comprising a strap being coupled to said top wall of said housing, said strap being extendable over a finger of the hand to secure said housing to the hand and facilitating maneuvering of said housing by the person.

8. The device according to claim 1, wherein said handle is telescopic to permit a length of said handle to be adjusted.

9. A body hair shaving device for shaving hair from a body of a person, said device comprising:

a housing being graspable by a hand of the person, said housing having a top wall, a bottom wall and a peripheral wall being attached to and extending between said top and bottom walls, said housing having a bay extending therein, a door being coupled to said housing and being selectively positionable in a closed position extending over said bay, said housing being divided into a first section and a second section each approximately having a same size and shape, said first section being hingedly coupled to said second section, said housing being positionable in a closed position having said bottom wall of said first and second sections being adjacent to each other and an open position having said top wall of said first and second sections lying in a same plane;

a razor assembly being coupled to said housing, said razor assembly including a plurality of shaving heads being coupled to and outwardly extending from said bottom wall of said housing and a at least one motor assembly engaging and selectively actuating each of said shaving heads, said shaving heads being drawn across the body of the person to shave the hair from the body when the razor assembly is turned on, at least one of said shaving heads being positioned on said first section and at least one of said shaving heads being positioned on said second section;

a power supply being positionable in said bay of said housing, said power supply supplying power to said razor assembly;

a biasing member being coupled to said first section and said second section of said housing, said biasing member biasing said first and second sections into said open position;

a strap being coupled to said top wall of said housing, said strap being extendable over a finger of the hand to secure said housing to the hand and facilitating maneuvering of said housing by the person; and a handle being releasably coupled to said housing, said handle being graspable by the person to extend a reach of the person when shaving the body, said handle being telescopic to permit a length of said handle to be adjusted.

* * * * *